US008833764B2

(12) United States Patent
Kashiba et al.

(10) Patent No.: US 8,833,764 B2
(45) Date of Patent: Sep. 16, 2014

(54) SHEET FEEDING MACHINE

(75) Inventors: Masayuki Kashiba, Shiga (JP); Akira Onodera, Shiga (JP); Jun Mochizuki, Shiga (JP)

(73) Assignee: Horizon International Inc., Takashima-shi (JP)

( * ) Notice: Subject to any disclaimer, the term of this patent is extended or adjusted under 35 U.S.C. 154(b) by 0 days.

(21) Appl. No.: 13/976,270

(22) PCT Filed: Sep. 26, 2011

(86) PCT No.: PCT/JP2011/071880

§ 371 (c)(1),
(2), (4) Date: Jun. 26, 2013

(87) PCT Pub. No.: WO2013/046295

PCT Pub. Date: Apr. 4, 2013

(65) Prior Publication Data

US 2013/0270766 A1 Oct. 17, 2013

(51) Int. Cl.

| | |
|---|---|
| ***B65H 7/02*** | (2006.01) |
| ***B65H 7/14*** | (2006.01) |
| ***B65H 5/06*** | (2006.01) |
| ***B65H 7/06*** | (2006.01) |
| ***B65H 7/20*** | (2006.01) |
| ***B65H 9/00*** | (2006.01) |
| *B42C 1/12* | (2006.01) |

(52) U.S. Cl.

CPC ..... *B65H 7/20* (2013.01); *B65H 2402/343* (2013.01); *B65H 2511/415* (2013.01); *B65H 7/14* (2013.01); *B65H 2553/412* (2013.01); *B65H 5/062* (2013.01); *B65H 2551/29* (2013.01); *B65H 2511/22* (2013.01); *B65H 7/06* (2013.01); *B65H 2553/81* (2013.01); *B65H 9/00* (2013.01); *B65H 2553/822* (2013.01); *B65H 2801/48* (2013.01); *B42C 1/12* (2013.01); *B65H 2511/512* (2013.01); *B65H 2553/83* (2013.01)

USPC ..... 271/265.01; 250/559.44

(58) Field of Classification Search

USPC ..... 271/265.01, 265.02, 265.03; 250/548, 250/559.01, 559.12, 559.15, 559.04–559.1, 250/559.44

See application file for complete search history.

(56) References Cited

U.S. PATENT DOCUMENTS 5,260,583 A * 11/1993 Rye ..... 250/559.42
6,846,121 B2 * 1/2005 Bouverie et al. ..... 400/693

(Continued)

FOREIGN PATENT DOCUMENTS

JP 55-135052 A 10/1980
JP 2002-067408 A 3/2002

(Continued)

OTHER PUBLICATIONS

International Search Report for PCT/JP2011/071880, Mailing Date of Nov. 1, 2011.

(Continued)

*Primary Examiner* — Jeremy R Severson

(74) *Attorney, Agent, or Firm* — Westerman, Hattori, Daniels & Adrian, LLP

(57) ABSTRACT

A sheet feeding machine comprises a housing 1, a feed section for feeding a plurality of sheets 40 in a feed direction 11, and a detecting section 3 having detector 30, 31 for detecting information 41, 42 printed on the sheet 40. The detecting section 3 comprises a support frame 32 for supporting the detector 30, 31, a guide rail 33 mounted on the support frame 32 and extending for guiding the detector 30, 31, and a guide mechanism 35 arranged between the housing 1 and the support frame 32 for guiding the support frame 32. The support frame 32 can be accommodated in the housing 1 when detecting the information 41, 42 of the sheet 40. The support frame 32 can be drawn out of the housing 1 when moving the detector 30, 31 along the guide rail 33.

6 Claims, 5 Drawing Sheets

(56) References Cited

U.S. PATENT DOCUMENTS

| | | | | |
|---|---|---|---|---|
| 7,187,457 | B2 * | 3/2007 | Kobayashi | 356/639 |
| 2004/0252353 | A1 | 12/2004 | Sano et al. | |
| 2007/0144373 | A1 | 6/2007 | Okura et al. | |
| 2012/0001386 | A1 * | 1/2012 | Nishikata et al. | 271/265.01 |
| 2013/0099142 | A1 * | 4/2013 | Bouverie et al. | 250/559.42 |

FOREIGN PATENT DOCUMENTS

| | | | |
|---|---|---|---|
| JP | 2005-012782 | A | 1/2005 |
| JP | 2005-119797 | A | 5/2005 |
| JP | 2007-167975 | A | 7/2007 |

OTHER PUBLICATIONS

International Preliminary Report on Patentability (form PCT/IB/373) dated Apr. 1, 2014, issued in International Application No. PCT/JP2011/071880 and form PCT/ISA/237 (4 pages).

* cited by examiner

Fig. 5A
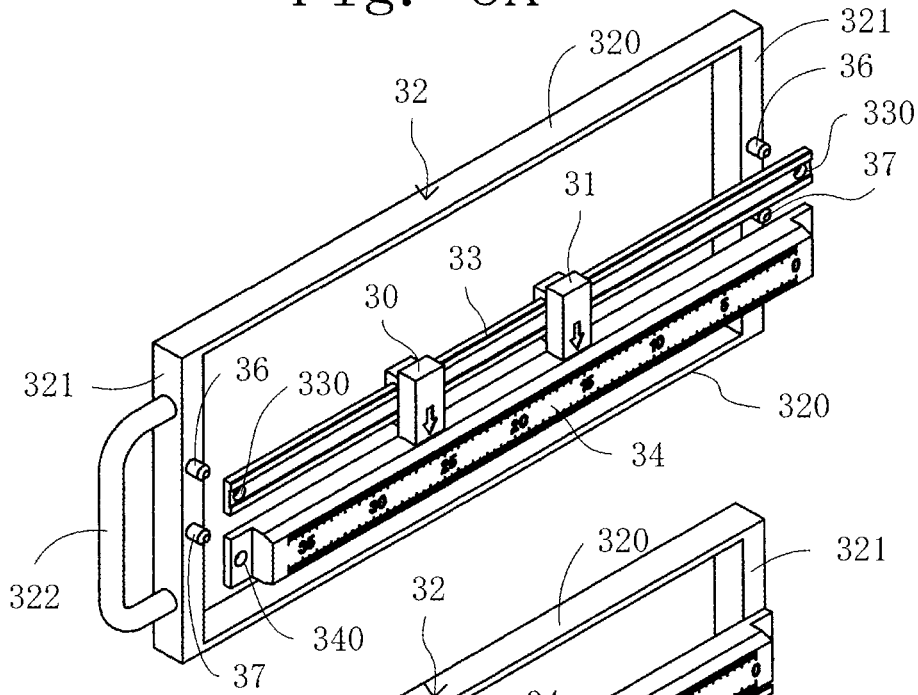
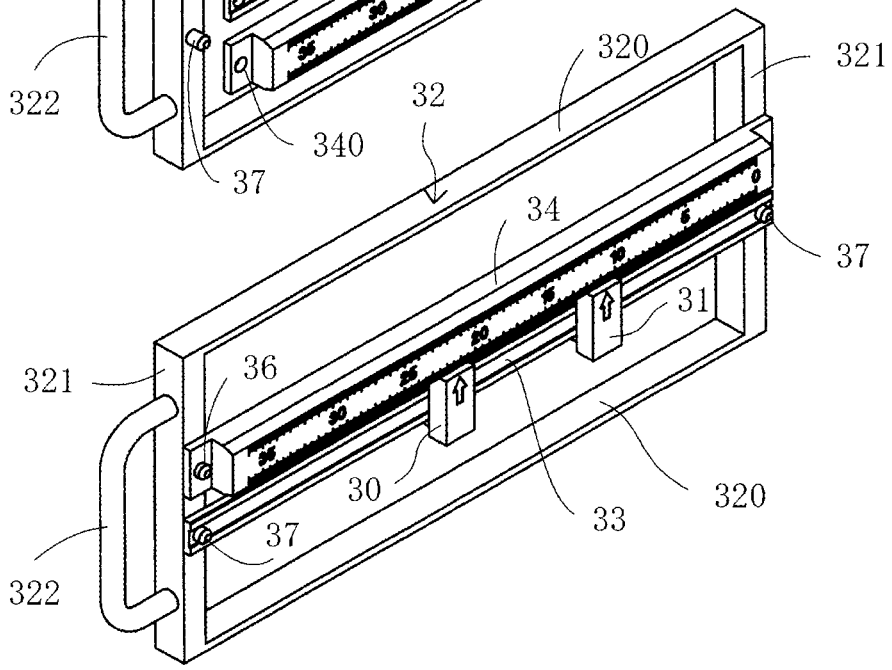
Fig. 5B

SHEET FEEDING MACHINE

TECHNICAL FIELD OF THE INVENTION

The present invention relates to a sheet feeding machine for feeding sheets from a printer and so on to a book binding apparatus.

BACKGROUND OF THE INVENTION

There is a sheet feeding machine for supplying a sheet one by one to a book binding apparatus from a sheet stack which is formed by a printer or a copier and configured by plural sets of sheets collated by page order, each of which corresponds to one volume. The book binding apparatus binds the sheets fed from the sheet feeding machine for each set of sheets which corresponds to one volume (see for example Patent Document 1).

Such sheet feeding machine should feed sheets to the book binding apparatus for each set of sheets which corresponds to one volume. Therefore, information for identifying the front and last pages of a set of sheets which corresponds to one volume, for example mark, bar-cord or image, is printed on the sheet. The machine further comprises a detecting section for detecting the information so as to feed the sheets to the book binding apparatus for each set of sheets which corresponds to one volume based on the detection signal of the detecting section.

For example, the detecting section has one detector if the information is printed on the only front page, while the detecting section has two detectors if the information is printed on both front and last pages. The information may be printed on the various positions on the upper or lower side of the sheet. The position on which the information is printed depends on the contents printed on the sheet. Thus, the detector should be moved to a proper position so as to detect the information.

However, the conventional machine is not configured to easily move the detector. An operator wastes time and effort to move the detector because he or she cannot easily access the detector installed in the machine in which there is a plurality of various parts. Additionally, in the conventional machine, an operator cannot confirm the exact position of the detector. Thus, the detection error is caused if the detector is not set at the proper position.

Patent Document 1: JP 2005-119797

SUMMARY OF THE INVENTION

Problems to be Solved by the Invention

It is an object of the present invention to provide a sheet feeding machine, in which an operator can easily move the detector to the proper position thereof and confirm the exact position thereof.

Solution to the Problems

A sheet feeding machine comprises:

a housing;

a feed section for feeding a plurality of sheets placed on a sheet tray in a feed direction; and a detecting section having at least one detector for detecting information printed on the sheet, wherein the detecting section comprises:

a support frame for supporting the detector;

a horizontal guide rail mounted on the support, frame and extending perpendicularly to the feed direction so as to guide the detector; and a guide mechanism arranged between the housing and the support frame for guiding the support, frame in such a manner that the support, frame moves into and out of the housing perpendicularly to the feed direction and in the horizontal direction, and wherein the support frame is accommodated in the housing when the detector detects the sheet fed from the feed section, and the support frame is drawn out of the housing when the detector is moved along the guide rail.

According to a preferable embodiment, the support frame comprises:

a pair of horizontal members arranged parallel to each other; and a pair of vertical members arranged parallel to each other and extending between the horizontal members, wherein the guide mechanism comprises:

a pair of horizontal telescopic arms which is actuated perpendicularly to the feed direction, the telescopic arms being attached to the housing at one end thereof and attached to the support frame at the other end thereof, and wherein each of the telescopic arms is attached to the horizontal members of the support frame.

According to a preferable embodiment, the machine further comprises:

attachments for detachably attaching the guide rail to the support frame, wherein the attachments comprise:

an upper portion disposed on the support frame above the sheet fed from the feed section so as to detachably attach the guide rail; and a lower portion disposed on the support frame below the sheet fed from the feed section so as to detachably attach the guide rail; and wherein the detector detects the information printed on an upper side of the sheet while the guide rail is attached to the upper portion, the detector detects the information printed on a lower side of the sheet while the guide rail is attached to the lower portion.

According to a preferable embodiment, the machine further comprises:

a reflective arm for reflecting light emitted from the detector, and wherein the reflective arm is detachably attached to the upper and lower portions of the attachments in such a manner that the reflective arm extends in parallel to the guide rail when the reflective arm is attached to the support frame.

According to a preferable embodiment, each of the upper and lower portions of the attachments is pin-shaped and projects from the support frame so as to be inserted into and removed from a hole which is formed on the guide rail.

According to a preferable embodiment, the reflective arm has a scale for confirming an exact potion of the detector.

Effect of the Invention

As above described, the sheet feeding machine according to the present invention comprises the housing, the feed section for feeding the sheets placed on a sheet tray in a feed direction, and the detecting section having at least one detector for detecting information printed on the sheet. The detecting section comprises the support frame for supporting the detector, the horizontal guide rail mounted on the support frame so as to guide the detector, and the guide mechanism arranged between the housing and the support frame for guiding the support frame in such a manner that the support frame moves into and out of the housing perpendicularly to the feed direction and in the horizontal direction.

Thus, an operator can draw the support frame together with the detector out of the housing so as to easily move the detector along the guide rail without wasting time and effort. Further, an operator can confirm the exact position of the detector so as to prevent the detection error from being caused by the improper position of the detector.

BRIEF DESCRIPTION OF THE DRAWING

FIG. 5A is a perspective view of the support frame when the guide rail and the reflective arm are removed from the support frame.

FIG. 5B is a perspective view of the support frame when the guide rail is disposed on the lower side of the support frame and the reflective arm is disposed on the upper side thereof.

DETAILED EXPLANATION OF THE PREFERRED EMBODIMENTS

A sheet feeding machine according to the present invention will be explained below with reference to the accompanying drawings.

Figure 1:
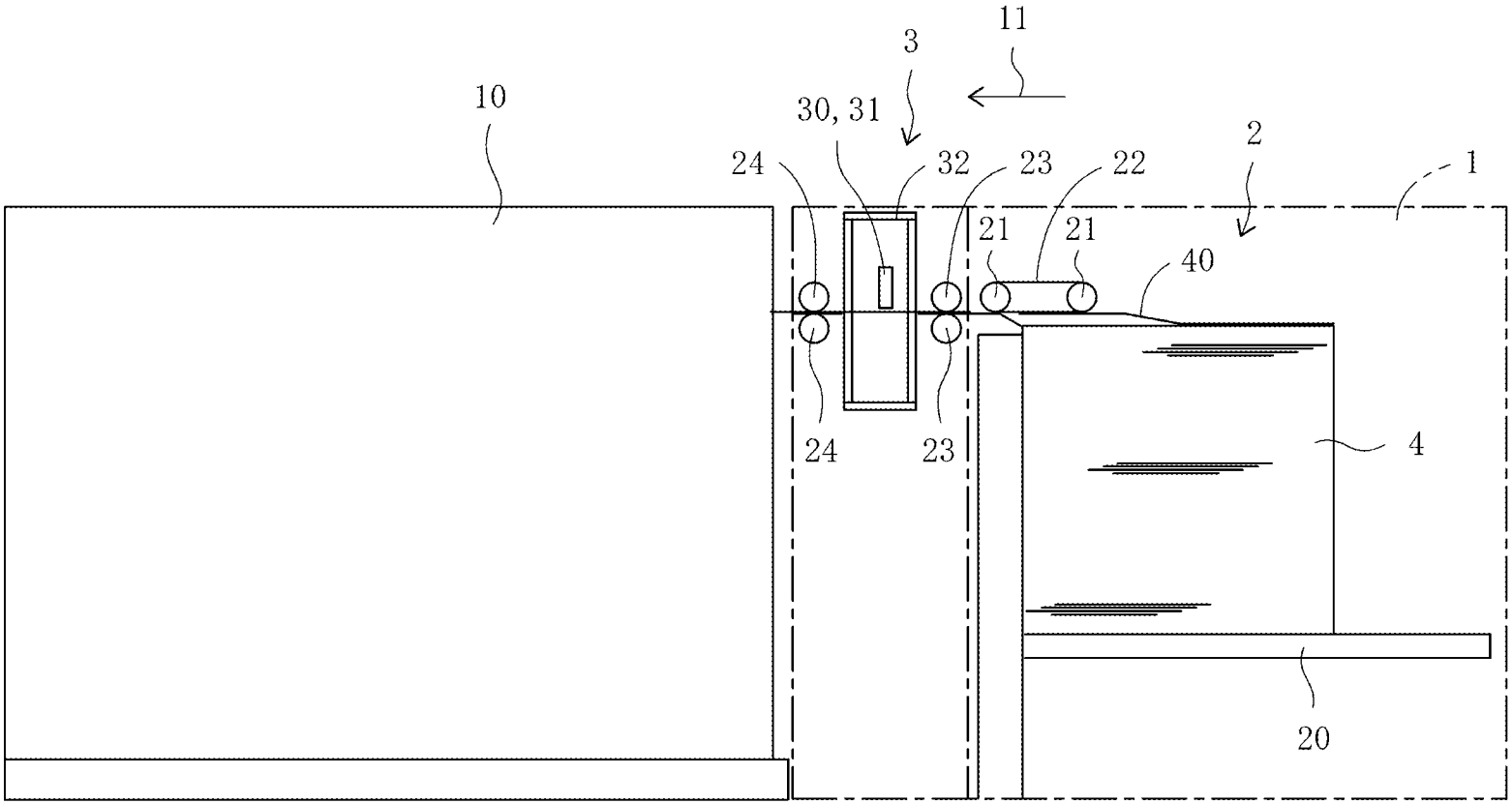
FIG. 1 is a side view of the sheet feeding machine according to the present invention.

As shown in FIG. 1 the sheet feeding machine comprises a housing 1. The housing 1 consists of a wall or frame so as to cover a whole or a part of the machine. The machine comprises a feed section 2 and a detecting section 3. The feed section 2 and the detecting section 3 are accommodated in the housing 1. The feed section 2 has a sheet tray 20 on which a sheet stack 4 is placed. The sheet stack 4 consists of a plurality of sheets 40 fed from a printer or a copier (not shown). The sheet stack 4 is configured by plural sets of sheets 40 collated by page order, each of which corresponds to one volume.

The feed section 2 has a pair of sheet feeding rollers 21, 21 for feeding a sheet 40 in a feed direction 11. The top sheet 40 of the sheet stack 4 placed on the sheet tray 20 is fed one by one. A belt 22 is extended between the sheet feeding rollers 21, 21. The belt 22 is circulated by the sheet feeding rollers 21, 21. A plurality of holes is provided on the belt 22, and a suction device (not shown) is arranged inside the belt 22. Thus, the sheet 40 is sucked and conveyed by the circulated belt 22 in the feed direction 11. A sensor (not shown) detects the change of the height of the sheet stack 4. The sheet tray 20 moves up and down to adjust the height of the sheet 40 based on a detection signal of the sensor so that the sheet feeding rollers 21 can feed the top sheet 40 of the sheet stack 4 one by one.

The feed section 2 has a pair of first discharge rollers 23 and a pair of second discharge rollers 24. The first and second discharge rollers 23, 24 are spaced from each other in the feed direction 11. The first discharge rollers 23 are opposed to each other vertically and rotated respectively. The second discharge rollers 24 are also opposed to each other vertically and rotated respectively. The sheet 40 is fed by the sheet feeding rollers 21, and nipped between the first discharge rollers 23, and fed in the feed direction 11 by the first discharge rollers 23, and nipped between the second discharge rollers 24, and then fed in the feed direction 11 by the second discharge rollers 24. The sheet 40 is discharged from the machine and fed toward a book binding apparatus 10.

The machine comprises a detecting section 3. The detecting section 3 is disposed between the first and second discharge rollers 23, 24. The detecting section 3 has first and second detectors 30, 31. It is necessary to identify the front and last pages of a set of sheets 40 which corresponds to one volume, because the sheet stack 4 is configured by plural sets of sheets 40. Thus, information to be detected by the detectors 30, 31 is printed on the sheet 40 so as to identify the front and last pages.

Figure 2:
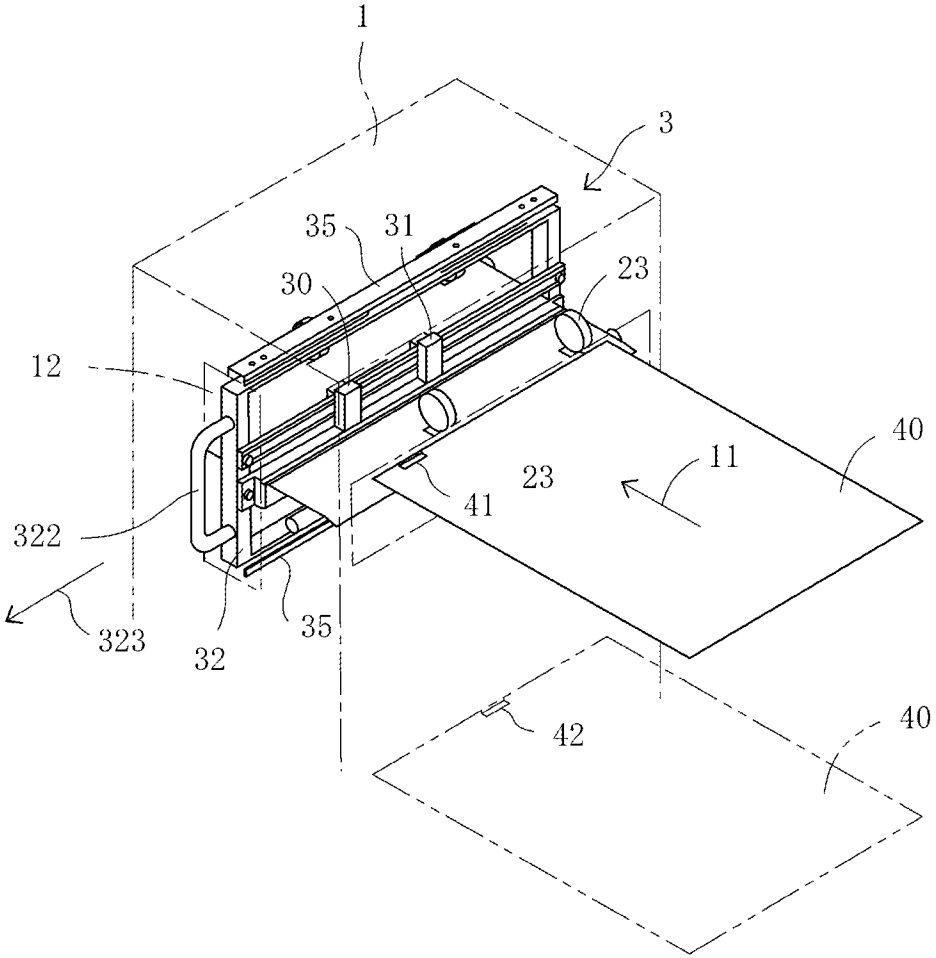
FIG. 2 is a perspective view of the sheet feeding machine when the support frame is accommodated in the housing.

As shown in FIG. 2, a first mark 41 as the information is printed on the front page of the set of sheets 40. A second mark 42 as information is printed on the last page of the set of sheets 40. The first detector 30 identifies the sheet 40 fed from the first discharge rollers 23 as the front page by the detection of the first mark 41. The second detector 31 identifies the sheet 40 fed from the first discharge rollers 23 as the last page by the detection of the second mark 42.

When the detector 30 does not detect the next first mark 41 (on the front page) right after detecting the second mark 42 (on the last page), the detector 30 sends a detection error signal to stop the machine. In this embodiment, two detectors 30, 31 are arranged for independently detecting the front and last pages, so that the accuracy of the detection of the error can be improved.

The detectors 30, 31 emit light and detect amount of the light reflected from the sheet 40 so as to detect the first and second marks 41, 42. When the first and second marks 41, 42 are printed on the upper side of the sheets 40, the first and second detectors 30, 31 are disposed above the sheets 40. The first detector 30 is arranged in such a manner that the first mark 41 can pass underneath the first detector 30. The second detector 31 is arranged in such a manner that the second mark 42 can pass underneath the second detector 31.

Figure 3:
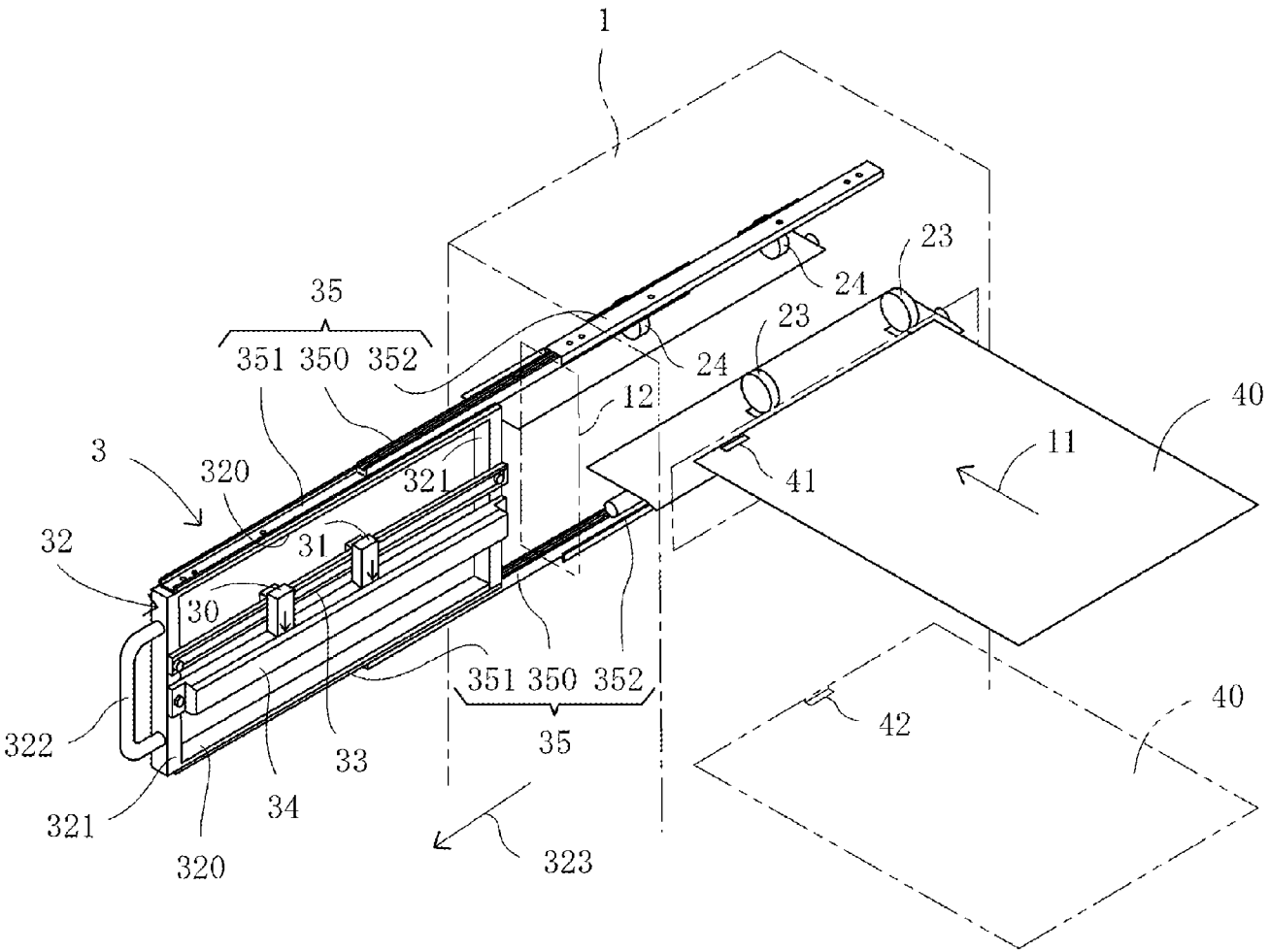
FIG. 3 is a perspective view of the sheet feeding machine when the support frame is drawn out of the housing.

As shown in FIGS. 2 and 3, the first and second detectors 30, 31 are supported by a support frame 32. The support frame 32 comprises a pair of horizontal members 320. The horizontal members 320 are arranged in parallel to each other. The support frame 32 further comprises a pair of vertical members 321. The vertical members 321 are arranged in parallel to each other and extending between the horizontal members 320. The support frame 32 is rectangle-shaped. The sheet 40 can pass the inside of the rectangle-shaped support frame 32. The sheet 40 is fed by the first discharge rollers 23 in feed direction 11, and passes the inside of the support frame 32, and then discharged out of the machine by the second discharge rollers 24.

Figure 4:
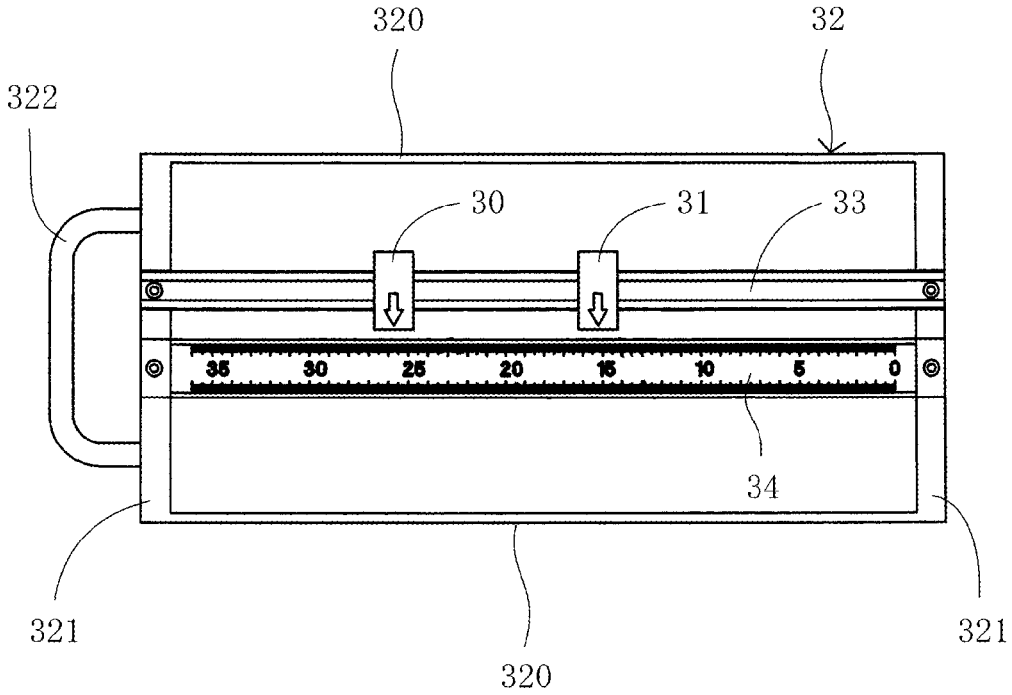
FIG. 4 is a front view of the support frame.

As shown in FIGS. 2 to 4, a horizontal guide rail 33 is mounted on the support frame 32. The guide rail 33 is arranged perpendicularly to the feed direction 11 and extends in parallel to the horizontal members 320. The detectors 30, 31 can slide along the guide rail 33. As above described, since the marks 41, 42 are printed on the various positions of the sheet 40 depending on contents printed on the sheet 40, the position of the detectors 30, 31 should be adjusted corresponding to the position of the marks 41, 42 so as to detect them properly.

A reflective arm 34 is attached to the support frame 32 and disposed beneath the guide rail 33. The reflective arm 34 extends in parallel to the guide rail 33. The light emitted from the detectors 30, 31 is reflected by the upper side of the reflective arm 34. The reflective arm 34 has a scale at its front side. An operator can confirm the exact position of the detectors 30, 31 by use of the scale of the reflective arm 34. The detectors 30, 31 can be disposed properly in such a manner that the marks 41, 42 printed on the sheet 40 can pass underneath the detectors 30, 31.

The detecting section 3 has a guide mechanism 35 for guiding the support frame 32 perpendicularly to the feed direction 11 and in the horizontal direction 323. The support frame 32 can be moved into and out of the housing 1 by use of the guide mechanism 35. In this embodiment, the support frame 32 can pass through an opening 12 formed in the side wall of the housing 1 (FIGS. 2 and 3).

In this embodiment, the guide mechanism 35 comprises an upper and lower horizontal telescopic arms which are actuated perpendicularly to the feed direction 11. Each of the telescopic arms 35 comprises a first fixed rail 351 mounted on the horizontal member 320 of the support frame 32, a second fixed rail 352 mounted on the housing 1, and a slider 350 attached to the first and second fixed rails 351, 352. The slider 350 can slide along the first and second fixed rails 351, 352. Each of the telescopic arms 35 can be contracted by superimposing the first and second fixed rails 351, 352 and sliders 350 (FIG. 2), on the other hand, it can be expanded by drawing the support frame 32 out of housing 1 and sliding the slider 350 along the first and second fixed rails 351, 352 (FIG. 3).

While the support frame 32 is accommodated in the housing 1 by contracting the telescopic arms 35, the detectors 30, 31 can detect the marks 41, 42 of the sheet 40. On the other hand, while the support frame 32 is drawing out of the housing 1 by expanding the telescopic arms 35, an operator can easily move the detectors 30, 31 at the outside of the housing 1 to position the detectors 30, 31. When the position of the marks 41, 42 are changed, an operator can draw the support frame 32 out of the housing 1 and easily adjust the positions of the detectors 30, 31 along the guide rail 33 at the outside of the housing 1. Thus, the operator can easily move the detectors 30, 31 and confirm the position thereof. A handle 322 is mounted on the support frame 32 in such a manner that the support frame 32 can be easily moved into and out of the housing 1.

As shown in FIG. 5, the support frame 32 has attachments 36, 37. The attachments 36, 37 are configured to detachably attach the guide rail 33 to the support frame 32. The attachment 36 comprises a pair of upper portions 36, and the attachment 37 comprises a pair of lower portions 37. The upper and lower portions 36, 37 are disposed on the vertical members 321 of the support frame 32. The upper portion 36 is spaced from the lower portion 37 at a predetermined interval. The upper and lower portions 36, 37 is pin-shaped and projects toward the front side of the support frame 32. The guide rail 33 has a pair of holes 330 at both ends thereof for inserting the upper or lower portion 36, 37. The reflective arm 34 has a pair of holes 340 at both ends thereof for inserting the upper or lower portion 36, 37. The guide rail 33 and the reflective arm 34 are attached to the support frame 32 in such a manner that the holes 330, 340 can be inserted into and removed from the upper and lower portions 36, 37. Thus, the guide rail 33 and the reflective arm 34 can be detachably attached to the support frame 32 easily.

In case that the marks 41, 42 is printed on the lower side of the sheet 40, at first, the guide rail 33 and the reflective arm 34 are removed from the support frame 32 (FIG. 5A). Next, the guide rail 33 is disposed on the lower side of the support frame 32 in such a manner that the light emitted from the detectors 30, 31 can be toward the upper side. And the reflective arm 34 is disposed on the upper side of the support frame 32 so as to reflect the light emitted from the detectors 30, 31. And then, the guide rail 33 is attached to the lower side of the support frame 32, and the reflective arm 34 is attached to the upper side of the support frame 32 (FIG. 5B). In this operation, an operator can draw the support frame 32 out of the housing 1 so as to easily change the positional relation of the guide rail 33 and the reflective arm 34.

Although, in this embodiment, the guide mechanism 35 comprises the telescopic arms having the first and second fixed rails 351, 352 and sliders 350, another means may be used as the guide mechanism 35. For example, the another means may comprise the first fixed rails 351 mounted on the support frame 32 and the second fixed rails 352 mounted on the housing 1, and the first and second rails 351, 352 are engaged with each other for slide movement.

Although, in this embodiment, the detectors 30, 31 emits light toward the marks 41, 42, the constructions of the detectors 30, 31 are not limited to this embodiment. For example, if the information is a bar-code, bar-code readers should be used as the detectors 30, 31. If the front and last pages are identified based on contents printed on the sheet 40, CCD cameras may be used as the detectors 30, 31. If only one of the front and last page should be detected, a single detector is used for detecting information.

Although, in this embodiment, the attachments 36, 37 comprise the pin-shape members 36, 37 and the holes 330, 340, another means may be used. For example, a velvet fastener, a combination of bolt and nut and so on can be used as the attachments 36, 37.

DESCRIPTION OF THE REFERENCE CHARACTERS

1 housing
2 feed section
3 detecting section
11 feed direction
30, 31 detector
32 support frame
320 horizontal member
321 vertical member
33 horizontal guide rail
34 reflective arm
35 guide mechanism (horizontal telescopic arm)
36 upper portions (attachment)
37 lower portions (attachment)
40 sheet
41, 42 mark (information)
330 hole of the guide rail
340 hole of the reflective arm

The invention claimed is:

1. A sheet feeding machine, comprising:
a housing;
a feed section for feeding a plurality of sheets placed on a sheet tray in a feed direction; and
a detecting section having at least one detector for detecting information printed on the sheet, wherein
the detecting section comprises:
a support frame for supporting the detector;
a horizontal guide rail mounted on the support frame and extending perpendicularly to the feed direction so as to guide the detector; and
a guide mechanism arranged between the housing and the support frame for guiding the support frame in such a manner that the support frame moves into and out of the housing perpendicularly to the feed direction and in the horizontal direction, and wherein the support frame is accommodated in the housing when the detector detects the sheet fed from the feed section, and the support frame is drawn out of the housing when the detector is moved along the guide rail.

2. The machine according to claim 1, wherein the support frame comprises:

a pair of horizontal members arranged parallel to each other; and a pair of vertical members arranged parallel to each other and extending between the horizontal members, wherein the guide mechanism comprises:

a pair of horizontal telescopic arms which is actuated perpendicularly to the feed direction, the telescopic arms being attached to the housing at one end thereof and attached to the support frame at the other end thereof, and wherein each of the telescopic arms is attached to the horizontal members of the support frame.

3. The machine according to claim 1, further comprising:

attachments for detachably attaching the guide rail to the support frame, wherein the attachments comprise:

an upper portion disposed on the support frame above the sheet fed from the feed section so as to detachably attach the guide rail; and a lower portion disposed on the support frame below the sheet fed from the feed section so as to detachably attach the guide rail; and wherein the detector detects the information printed on an upper side of the sheet while the guide rail is attached to the upper portion, the detector detects the information printed on a lower side of the sheet while the guide rail is attached to the lower portion.

4. The machine according to claim 3, further comprising:

a reflective arm for reflecting light emitted from the detector, and wherein the reflective arm is detachably attached to the upper and lower portions of the attachments in such a manner that the reflective arm extends in parallel to the guide rail when the reflective arm is attached to the support frame.

5. The machine according to claim 3, wherein each of the upper and lower portions of the attachments is pin-shaped and projects from the support frame so as to be inserted into and removed from a hole which is formed on the guide rail.

6. The machine according to claim 4, wherein the reflective arm has a scale for confirming an exact potion of the detector.

* * * * *